United States Patent [19]

Ramseier et al.

[11] 4,355,665

[45] Oct. 26, 1982

[54] HEDDLE

[75] Inventors: Paul Ramseier, Pfäffikon; Hans Burkhalter, Schönenberg, both of Switzerland

[73] Assignee: Bräcker AG, Pfäffikon, Switzerland

[21] Appl. No.: 190,313

[22] PCT Filed: Aug. 31, 1979

[86] PCT No.: PCT/CH79/00115

§ 371 Date: May 26, 1980

§ 102(e) Date: May 8, 1980

[87] PCT Pub. No.: WO80/00719

PCT Pub. Date: Apr. 17, 1980

[51] Int. Cl.[3] ..... D03C 9/00

[52] U.S. Cl. ..... 139/96

[58] Field of Search ..... 139/93, 94, 95, 96

[56] References Cited

U.S. PATENT DOCUMENTS

| | | | |
|---|---|---|---|
| 887,102 | 5/1908 | Lackey | 139/96 |
| 1,413,949 | 4/1922 | Wagner | 139/96 |
| 1,930,151 | 10/1933 | Smith | 139/94 |
| 3,960,182 | 6/1976 | Schwarz | 139/94 |

FOREIGN PATENT DOCUMENTS 953185 8/1974 Canada .

OTHER PUBLICATIONS

Demin, "Konstruktsii pressform dlya plasticheskikh mass", 1952, pp. 38–39, Section 14, and FIGS. 16–18.

*Primary Examiner*—Henry Jaudon
*Attorney, Agent, or Firm*—Werner W. Kleeman

[57] ABSTRACT

A thread guiding eye, which may be made from case-hardened or rust-proof steel, is embedded in a heddle moulded from plastic. The embedding is effected by injection-moulding the plastic around the thread guiding eye. The thread guiding eye may have an essentially crescent-shaped profile, its edges being embedded in the plastic in order to ensure a smooth and uninterrupted transition. The longitudinal parts and/or the region of the thread guiding eye are at least approximately oval in cross-section. A heddle of this type combines the advantages of a metal heddle because of the reduced wear of the thread guiding eye and those of a non-metallic heddle because of its low weight.

8 Claims, 4 Drawing Figures

HEDDLE

BACKGROUND OF THE INVENTION

1. Field of the Invention

The invention relates to a heddle provided with a thread guiding eye.

2. Description of the Prior Art

Heddles in looms serve the purpose of raising or lowering the warp threads, which run through the central eye of the heddle, for forming the shed. Heddles of yarn, of metal and of plastic are known. In the case of yarn heddles the thread guiding eye is formed by an appropriate knotting of the yarn itself or a thread guiding eye of metal is woven or tied in. In the case of metal heddles the thread guiding eye is formed either by piercing a double wire soldered together, by stamping out from a round wire rolled flat or from a rolled broad strip, depending upon the type of material the heddle is made from, or a thread guiding eye, also known as a mail, is soldered into a recess in the split heddle. Known heddles of plastic are stamped in such a way as to include the thread guiding eye.

Considerable importance is attached to the thread guiding eye, since it is subjected to wear by the warp thread passing through it and the warp thread must not be damaged by friction. As inserted thread guiding eye of metal can best meet this requirement since the necessary fine machining, such as polishing, is possible during its manufacture and the thread guiding eye is internally rounded in the manufacturing process. In addition, a thread guiding eye of this type may be casehardened. With these thread guiding eyes, however, the expense of tying or weaving them into a yarn heddle is disadvantageous. Such an expense renders the heddles more costly. In addition, metal heddles are relatively heavy, so that the thread speed or the number of weft rounds is limited on account of the weight of the shaft.

SUMMARY OF THE INVENTION

The object of the invention, therefore, is to provide a heddle which has a wear-resistant thread guiding eye, may be manufactured relatively inexpensively and which makes possible a large number of weft picks.

The heddle construction according to the invention comprises a plastics material portion in which a warp thread guiding eye is inserted. The thread guiding eye is formed of a material which is glass or metal, wherein the thread guiding eye is embedded in the plastics material. The thread guiding eye is surrounded by the plastics material along its circumference and the edges of the thread guiding eye are interengaged by the plastics material.

A heddle of this type has generally the same advantages as a metal heddle with an inserted thread guiding eye, but it is considerably lighter than a metal heddle and is less noisy in operation since its end slots, which are brought into contact with metal, consist of plastic. In addition, it is rust-proof.

The invention also relates to a method for the manufacture of the heddle, in which the thread guiding eye is placed in an injection mould and the plastic is injected around it.

BRIEF DESCRIPTION OF THE DRAWINGS

One embodiment of the invention is explained in greater detail with reference to the drawing, in which.

DESCRIPTION OF THE PREFERRED EMBODIMENT

Figure 1:
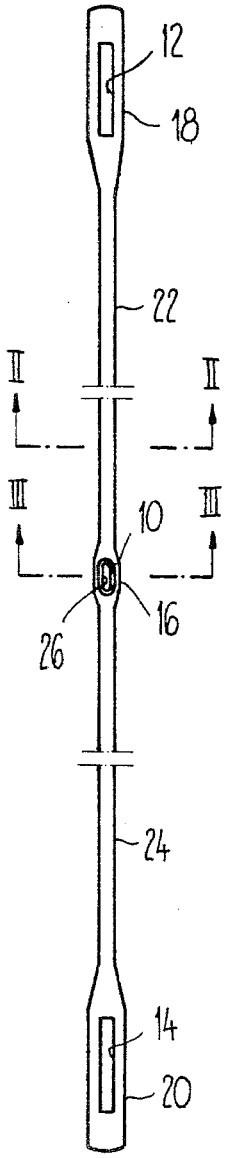
FIG. 1 is a plan view of a heddle with closed end slots.

The heddle illustrated in FIG. 1 has an inserted thread guiding eye 10 at its center and a closed end slot 12 and 14 respectively at each of its ends. The longitudinal parts 22 and 24 on opposite sides of the central part 16, which is enlarged in the area of the thread guiding eye 10, and the end portions 18 and 20 respectively, which are enlarged in the areas of the end slots 12 and 14, are shown shortened. The thread guiding eye 10 has an elongated opening 26. Instead of the closed end slots 12 and 14, the heddle can also have open end slots, which are used in particular in shaft weaving.

Figure 2:
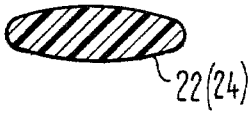
FIG. 2 is a cross-section along the line II—II of FIG. 1.

It is apparent from FIG. 2 that the cross-section of the longitudinal part 22 and that of the longitudinal part 24 is at least approximately oval.

Figure 3:
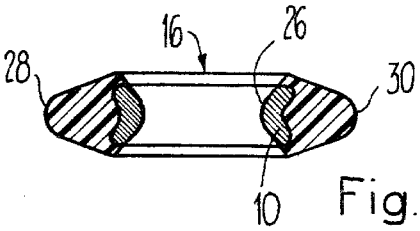
FIG. 3 is a cross-section along the line III—III of FIG. 1.

FIG. 3 shows in particular the approximately crescent-shaped profile of the thread guiding eye 10. The thread guiding eye 10 is embedded in the plastic of the central part 16. The thickness of the central part 16 decreases in the direction of the outer edges 28 and 30 respectively.

Figure 4:
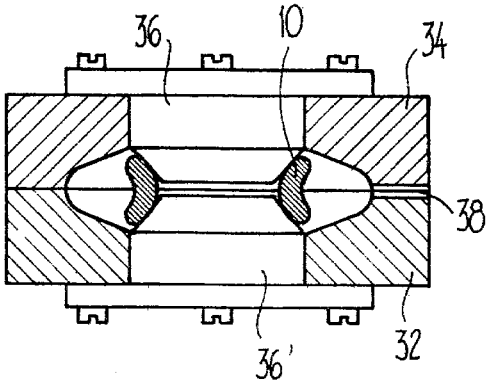
FIG. 4 is a cross-section through an injection mould for the manufacture of the heddle according to FIG. 1.

The heddle consisting of a plastic material is preferably made by an injection moulding process, in which plastic is moulded around the thread guiding eye 10 consisting of metal or glass. A case-hardenable or a rust-proof steel is preferably used as the metal. FIG. 4 shows an injection mould is cross-section with a thread guiding eye 10 inserted. The injection mould has a lower mould part 32 and an upper mould part 34. The lower mould part 32 is joined to a mandrel 36' and the upper mould part 34 is joined to a mandrel 36 in order to hold and center the thread guiding eye 10. The rounded ends of the two mandrels 36, 36' match the inside of the thread guiding eye 10. An opening 38 in the region of the thread guiding eye 10 is used for injecting the plastic. It is surprising that, despite the fact that there is a single injection point and the fact that the material reaches the end areas 18 and 20 of the heddle at a considerably lower temperature, there is an inner bond of the material beyond the end slots 12 and 14, since the highly fluid material for producing the heddle can flow rapidly and without obstruction into the end areas by means of a special hot nozzle device.

In the injection moulding, plastic is moulded around the edges of the thread guiding eye 10, which is crescent-shaped in profile, in order to obtain a smooth transition between the two materials. In contrast to a heddle consisting of metal, the resilience of a heddle consisting of plastic in its longitudinal direction is advantageous for the weaving process, since the transfer to the respective end position of the heddle in the formation of the shed takes place more smoothly and the warp thread is therefore exposed to less wear. A plastic heddle of this type is particularly suitable in the case of looms with Jacquard shed formation for use with resilient counterpulls.

The oval cross-section of the heddle in the region of the formation of the shed ensures a virtually friction-free passage of adjacent threads.

The foregoing preferred embodiment is considered illustrative only. Numerous modifications and changes will readily occur to those skilled in the art. However, these modifications and changes must be considered within the spirit of the invention and within the scope of the appended claims.

I claim:

1. A heddle comprising:

a plastics material portion formed of a plastics material;

a warp thread guiding eye inserted into said plastics material portion;

said thread guiding eye possesses a substantially crescent-shaped cross-sectional configuration;

said thread guiding eye being formed of a material which is harder than the plastics material of said plastics material portion;

said thread guiding eye being embedded in the plastics material of the plastics material portion;

said thread guiding eye being partially surrounded by the plastics material of said plastics material portion;

said thread guiding eye having outer edges which are molded around and interengaged by said plastics material of said plastics material portion; and said thread guiding eye having an inner surface which forms a smooth transition to the plastics material portion.

2. The heddle as defined in claim 1, wherein:

said material from which there is formed said thread guiding eye is glass.

3. The heddle as defined in claim 1, wherein:

said material from which there is formed said thread guiding eye is a metal.

4. The heddle as defined in claim 1, wherein:

said thread guiding eye is formed of case hardened steel.

5. The heddle as defined in claim 1, wherein:

said thread guiding eye is formed of stainless steel.

6. The heddle as defined in claim 1, wherein:

said plastics material portion possesses a central part and to each side thereof a longitudinal part;

said central part containing said thread guiding eye;

the cross-sectional configuration of said central part at the region of said thread guiding eye being at least substantially oval; and said central part possesses an enlarged shape in relation to that of said longitudinal parts and being interrupted by the thread guiding eye.

7. The heddle as defined in claim 1, wherein:

said plastics material portion possesses a central part and to each side thereof a longitudinal part;

said central part containing said thread guiding eye;

the cross-sectional configuration of said longitudinal parts at least at the region of said thread guiding eye being at least substantially oval; and said central part possesses an enlarged shape in relation to that of said longitudinal parts and being interrupted by the thread guiding eye.

8. The heddle as defined in claim 1, wherein:

said edges of said thread guiding eye are inset with respect to the surface of the plastics material portion where there is inserted said thread guiding eye.

* * * * *